US006613446B1

(12) United States Patent
Peters et al.

(10) Patent No.: US 6,613,446 B1
(45) Date of Patent: Sep. 2, 2003

(54) CONICAL HONEYCOMB BODY AND METHOD OF PRODUCING IT

(75) Inventors: Jürgen Peters, St. Augustin (DE); Wolfgang Maus, Bergisch Gladbach (DE); Ludwig Wieres, Overath (DE); Michael Voit, Leverkusen (DE)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 340 days.

(21) Appl. No.: 09/709,153

(22) Filed: Oct. 30, 2000

Related U.S. Application Data

(63) Continuation of application No. PCT/EP99/02586, filed on Apr. 16, 1999.

(30) Foreign Application Priority Data

Apr. 29, 1998 (DE) ..... 198 19 202

(51) Int. Cl.[7] ..... F01N 3/28; B01J 35/04

(52) U.S. Cl. ..... 428/593; 502/527.23; 428/599; 29/890; 422/180

(58) Field of Search ..... 428/593, 603, 428/599, 594; 502/527.22, 527.23, 439, 527.21; 422/180; 29/890

(56) References Cited

U.S. PATENT DOCUMENTS 3,907,708 A * 9/1975 Lacroix ..... 502/221
4,598,063 A * 7/1986 Retallick ..... 502/439
5,103,641 A * 4/1992 Maus et al. ..... 60/299
5,506,028 A * 4/1996 Bruck ..... 428/116
6,190,784 B1 * 2/2001 Maus et al. ..... 428/593
6,334,981 B1 * 1/2002 Wieres ..... 422/177
6,368,726 B1 * 4/2002 Holpp et al. ..... 428/593
2002/0108368 A1 * 8/2002 Hodgson ..... 60/286

FOREIGN PATENT DOCUMENTS

DE 3719773 A1 * 12/1988
DE 19825230 A1 * 12/1999

* cited by examiner

*Primary Examiner*—John J. Zimmerman
(74) *Attorney, Agent, or Firm*—Lawrence A. Greenberg; Werner H. Stemer; Ralph E. Locher

(57) ABSTRACT

A conical honeycomb body and method for producing the honeycomb body that avoids the deformations occurring when fixing a conical lamellar body in a conical casing tube is described. Clamping aids are disposed in the casing tube at a distance from its openings and are configured such that at least in sections they have a ring shape. The clamping aids allow for the economical production of conical honeycomb bodies having greater mechanical strength. Their variants make it possible to influence the function of the edge area of the conical honeycomb body in a targeted manner. Especially beading, necking and/or rings achieve, for example, a barrier effect so that no fluids are able to circulate in the channels situated in the edge area of the casing tube. The openings of the casing tube are free of inserted elements and can therefore be easily welded to other components of the exhaust-gas system.

27 Claims, 4 Drawing Sheets

FIG. 5
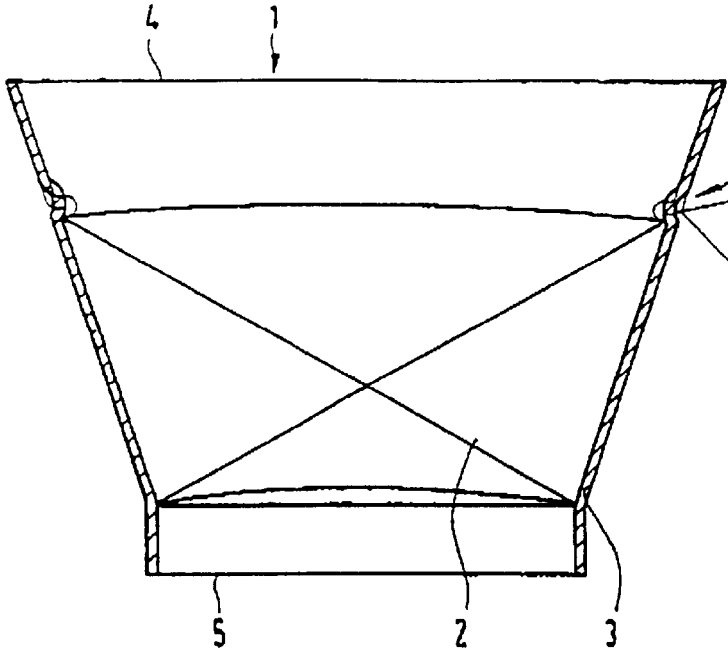
FIG. 6
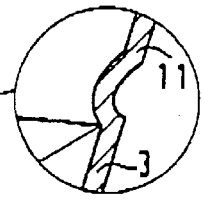
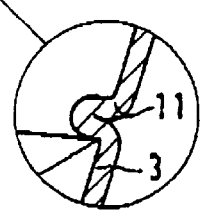
FIG. 7
FIG. 8
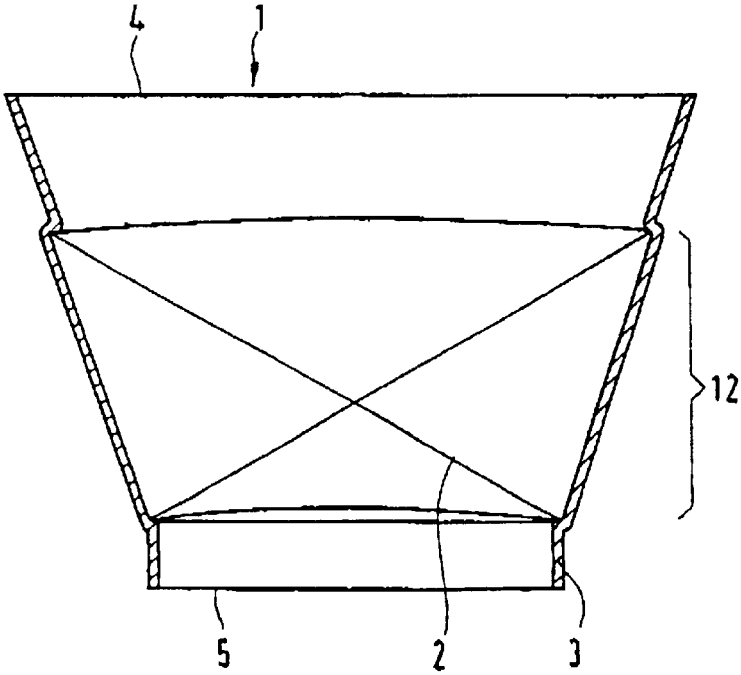

CONICAL HONEYCOMB BODY AND METHOD OF PRODUCING IT

Cross-Reference to Related Application

This is a continuation of International Application PCT/EP99/02586, filed Apr. 16, 1999, which designated the United States.

BACKGROUND OF THE INVENTION

Field of the Invention

The invention relates to a method of producing a conical honeycomb body having a conical foil assembly formed from structured arcuate sheet-metal foils that have been wound and/or stacked to form the conical foil assembly. The foil assembly is then inserted into a casing tube and the sheet-metal foils are fixed by a mechanical clamping aid. The invention further relates to such a honeycomb body. The honeycomb bodies are used in particular as catalyst support structures in exhaust systems of motor vehicles with an internal combustion engine.

Such a conical honeycomb body, with an axis and a casing tube which is conical in relation to the latter and into which a foil assembly wound about the axis in an involute manner is fitted, is known for example from European Patent EP 0 635 097 B1. The foil assembly has a multiplicity of sheet-metal foils, which are stacked one on top of the other and some of which are structured. Each sheet-metal foil is formed in the manner of a ring segment, so that it is delimited by an outer arc which is approximately circular with respect to a central point and an inner arc which is approximately circular, is concentric with respect to the outer arc and lies between the latter and the central point. Each structured sheet-metal foil has corrugations. The corrugation of a sheet-metal foil does not have a constant corrugation height over the entire sheet. The corrugation height must increase from a smaller corrugation height at the smaller arc delimiting the sheet-metal foil to a greater corrugation height at the larger arc delimiting the sheet-metal foil. The ratio of the corrugation heights must correspond approximately to the ratio of the corrugations of the arcs in order that an approximately conical honeycomb body is produced when the sheet-metal foils are intertwisted.

For this purpose, after they have been laminated and/or wound to form a conical foil assembly, which has passages through which a fluid can flow, the in some cases structured, arcuate sheet-metal foils are introduced into the conical casing tube with a first end opening and a second end opening, the first end opening having a larger diameter than the second end opening, are fixed by mechanical clamping aids and are subsequently connected at least partially to one another and to the casing tube by a joining technique, in particular they are soldered.

In this case, the fixing of the conical foil assembly in the conical casing tube is sometimes difficult to perform before the connection by a joining technique. Since, furthermore, the type of fixing may have an influence on the stability of the conical honeycomb body, which is particularly important wherever conical honeycomb bodies are used extremely close to the engine, this fixing does however take on particular significance.

For fixing a conical foil assembly in a conical casing tube it is known to insert two pins, offset radially by 180°, through the casing tube and the foil assembly and subsequently weld them to the casing tube. It is disadvantageous here that the pins close a certain number of honeycombs of the foil assembly, or deform them in the outer region. In addition, the insertion and welding of pins increases the production costs of such a honeycomb body.

Winding forks, which are connected to one another in such a way that a U shape is obtained, are also known. After the conical foil assembly has been wound and introduced into the conical casing tube, a flat steel plate that has bores at the same spacing as the winding forks is pushed over the winding forks. The winding forks are clamped on the flat steel plate by screws. However, the connection of the two winding forks may cause damage to the conical foil assembly during tightening.

To avoid deformations in particular, externally applied clamping devices, by which the casing tube and foil assembly are clamped, are possible. Owing to the temperatures in the soldering oven, however, the clamping tools must be made to be very robust. Such configurations have the effect of reducing the number of parts per batch. This leads to increased costs in the soldering process. The frequency of use of the clamping tools is also limited by the temperatures in the soldering oven.

Finally, known from the above-cited European Patent EP 0 635 097 B1 for fixing the conical foil assembly are retaining structures which are applied to the conical casing tube. The retaining structure may preferably be a lip running completely around the casing tube; such a lip may be formed, for example, by flanging of the casing tube, but it may also be a separate welded-on component. Another possibility for the retaining structure is a clip that is integrally connected, in particular welded, to the conical casing tube and reaches over the end face. Such a clip is disposed such that it is centered on the end face, so that it touches the central point of the latter. A clip disposed in such a way also has a disadvantageous effect, in particular on the flow characteristics of the exhaust gas to be cleaned.

SUMMARY OF THE INVENTION

It is accordingly an object of the invention to provide a conical honeycomb body and a method of producing it, that overcomes the above-mentioned disadvantages of the prior art methods and devices of this general type, with the intention of making the conical honeycomb body easier to produce and/or more stable by the simplest possible fixing of a conical foil assembly in a conical casing tube.

With the foregoing and other objects in view there is provided, in accordance with the invention, a method for producing a conical honeycomb body. The method includes the step of forming a conical foil assembly having passages formed therein through which a fluid can flow. The conical foil assembly is formed from arcuate sheet-metal foils being at least one of stacked and wound to form the conical foil assembly. At least some of the arcuate sheet-metal foils are structured sheet-metal foils. The conical foil assembly is introduced into a conical casing tube having a first end opening and a second end opening. The first end opening has a given diameter being larger than a given diameter of the second end opening. The conical foil assembly is fixed in the conical casing tube using a mechanical clamping aid. The mechanical clamping aid is disposed in the conical casing tube at a distance from the first end opening and the second end opening and, at least in portions, the mechanical clamping aid has an annular form. Subsequently, the arcuate sheet-metal foils are connected, at least partially, to one another and to the conical casing tube by a joining technique.

The fact that clamping aids are disposed in the conical casing tube at a distance from its end openings and are configured such that, at least in certain portions, they are of an annular form, simplifies the production of the conical honeycomb body, and at the same time facilitating the later welding into an exhaust system, since the ends are free of additional in-built components. In addition, the stability of the finished body is improved.

With the foregoing and other objects in view there is further provided, in accordance with the invention, a conical honeycomb body containing a conical casing tube having a first end opening and a second end opening. The first end opening has a given diameter and the second end opening has a given diameter being smaller than the given diameter of the first end opening. A conical foil assembly is disposed in the conical casing tube and is formed of arcuate sheet-metal foils being at least one of stacked and wound. At least some of the arcuate sheet-metal foils are structured sheet-metal foils and the arcuate sheet-metal foils are at least partially connected to each other and to the conical casing tube. The conical foil assembly further has passages formed therein through which a fluid can flow. A mechanical clamping aid is disposed in the conical casing tube at a distance from the first end opening and the second end opening and, at least in certain portions, has an annular form. The mechanical clamping aid fixes the conical foil assembly in the conical casing tube.

For this purpose, in a first embodiment, the casing tube has at a distance from the first end opening on its inner side a mechanically fixable ring, or at least mechanically fixable segments of a ring, with the result that the conical honeycomb body can in particular also be produced inexpensively.

Alternatively, the casing tube has at a distance from the first end opening a constriction, as a result of which, as in the case of the solutions with a ring as well, a type of air-gap insulation is produced, with the effect that the temperature of the casing tube does not increase too much during operation under load in a motor vehicle.

The casing tube may also have at a distance from the first end opening an outer bead, in which a prestressed ring can be disposed in a reversibly mechanical manner or by an irreversible joining technique, whereby, as in the case of the other solutions as well, the end openings of the casing tube remain free and can be welded well and easily to other components of an exhaust system.

The casing tube may also have at a distance from the first end opening an inner bead, with an axial force being exerted on the casing tube after the foil assembly has been introduced into the casing tube, the inner bead being deformed in such a way that the foil assembly is fixed in the casing tube. An inner bead, initially of an only relatively flat configuration, allows foil assemblies with a particularly high prestress also to be introduced easily into the casing tube and nevertheless to be fixed well.

A further solution provides that the casing tube has at a distance from the end openings an outer shoulder in corresponding to a width of the foil assembly. This solution is distinguished not only by improving its suitability for being welded in but in particular by good mechanical stability in the finished state of the conical honeycomb body.

Finally, the casing tube and the foil assembly may have a tongue-and-groove system. The casing tube having at a distance from the end openings, in the region of the maximum width of the foil assembly, at least one outer bead. Some of the structured arcuate sheet-metal foils are produced in such a way that at least one detent running at least around certain portions of the foil assembly is formed laterally on the foil assembly. Fixing by a tongue-and-groove system advantageously makes it possible, in particular, to ensure that the exhaust gas flows through the entire cross section of the conical honeycomb body and is fully passed on into a cylindrical honeycomb body disposed upstream or downstream, as appropriate.

With these solutions that are preferred according to the invention, the conical foil assembly can consequently be fixed in the conical casing tube in a simple and effective manner and can be produced at low cost, while increasing its mechanical stability in the finished state.

Other features which are considered as characteristic for the invention are set forth in the appended claims.

Although the invention is illustrated and described herein as embodied in a conical honeycomb body and a method of producing it, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 5 to 7 are sectional views of a fifth exemplary embodiment of the invention;

FIG. 8 is a sectional view of a sixth exemplary embodiment of the invention;

DESCRIPTION OF THE PREFERRED EMBODIMENTS

Figure 1:
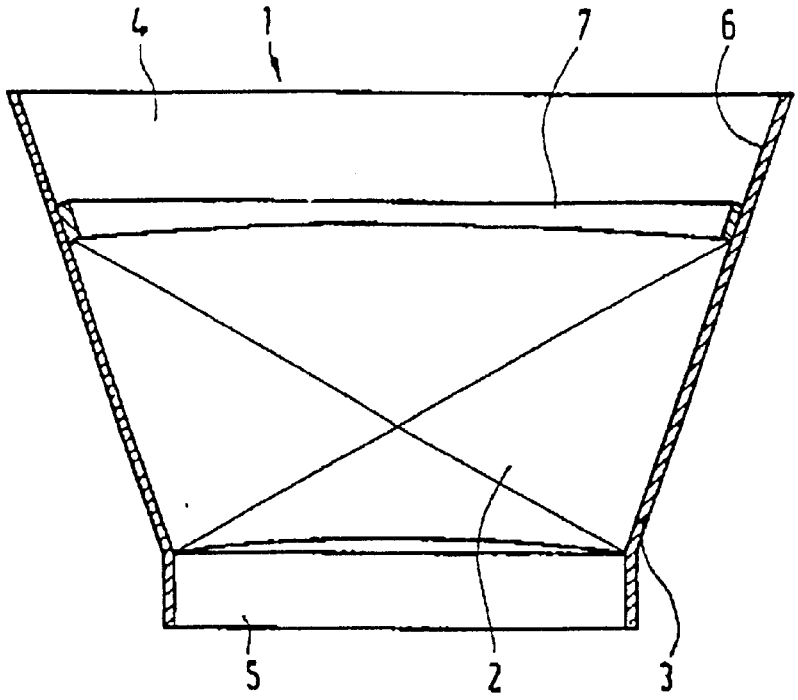
FIG. 1 is a diagrammatic, sectional view of a first exemplary embodiment according to the invention.

In all the figures of the drawing, sub-features and integral parts that correspond to one another bear the same reference symbol in each case. Referring now to the figures of the drawing in detail and first, particularly, to FIG. 1 thereof, there is shown a first exemplary embodiment of the invention. A conical honeycomb body 1 has a conical foil assembly 2 and a conical casing tube 3. The casing tube 3 has a first end opening 4 and a second end opening 5, the first end opening 4 having a greater diameter than the second end opening 5. The foil assembly 2 can be introduced into the casing tube 3 and fixed. The fixing takes place by a ring 7 that can be mechanically fixed at a distance from the first end opening 4 and on an inner side 6 of the casing tube 3. Alternatively, mechanically fixable segments of the ring 7 may also be provided. After it has been stacked and/or wound and when it is being forced into the casing tube 3, the foil assembly 2 has a certain prestress. On account of its prestress, after it has been introduced into the conical casing tube 3, the foil assembly 2 resiliently engages behind the ring 7 and is thereby fixed in the casing tube 3.

Figure 2:
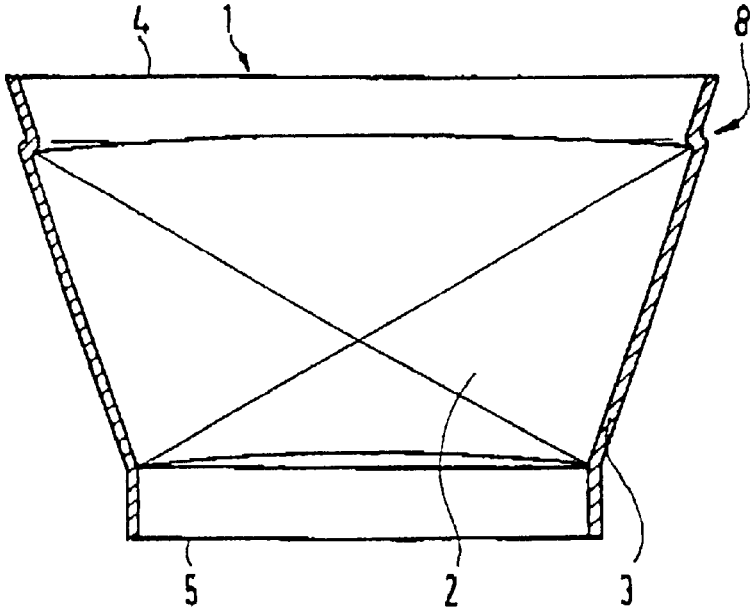
FIG. 2 is a sectional view of a second exemplary embodiment of the invention.

The conical honeycomb body 1 represented in FIG. 2 differs from that represented in FIG. 1 to the extent that the casing tube 3 has a constriction 8 at a distance from the first end opening 4. After it has been introduced beyond the constriction 8, the conical foil assembly 2 is fixed by the latter in the conical casing tube 3.

Figure 3:
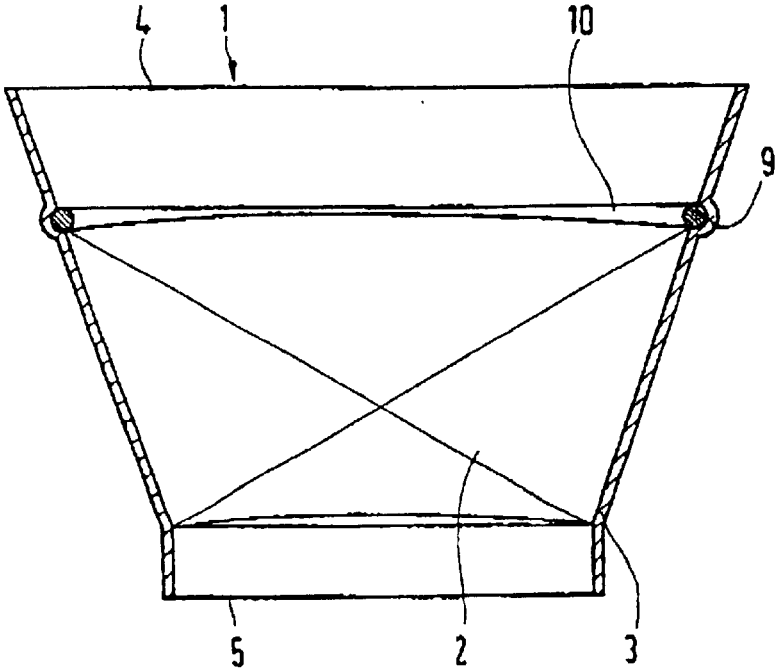
FIG. 3 is a sectional view of a third exemplary embodiment of the invention.

In the case of the conical honeycomb body 1 represented in FIG. 3, a bead 9 has been-made in the casing tube 3 with respect to an outer side and at a distance from the first end opening 4. After the conical foil assembly 2 has been introduced, a prestressed ring 10 is clamped into the bead 9 and fixes the foil assembly 2 in the casing tube 3. During the soldering process, the ring 10 is also soldered to the casing tube 3.

Figure 4:
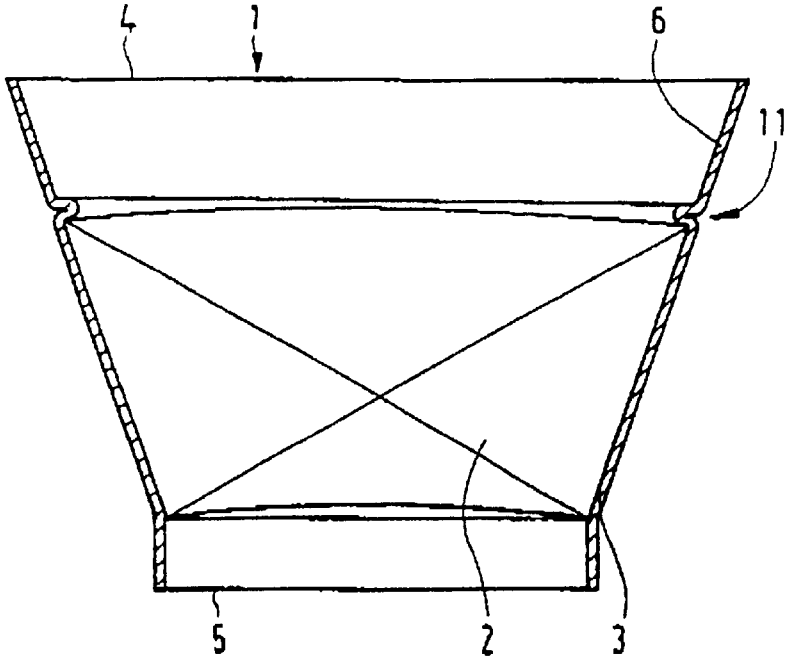
FIG. 4 is a sectional view of a fourth exemplary embodiment of the invention.

In the case of the conical honeycomb body 1 represented in FIG. 4, an inner bead 11 is made in the conical casing tube 3 with respect to an inner side 6. The conical foil assembly 2, having a prestress on account of its lamination and/or winding, is introduced past the inner bead 11, the prestress causing it to open out resiliently and consequently be fixed by the inner bead 11 in the casing tube 3.

The inner bead 11 according to FIGS. 5 to 7 differs from that according to FIG. 4 to the extent that initially, as can be seen in FIG. 6, it is of an only relatively flat configuration. The conical foil assembly 2 is introduced into the conical casing tube 3 over the bead 11. After it has been introduced, a force is exerted axially with respect to the conical casing tube 3, the inner bead 11 being deformed, as represented in FIG. 7, such that the foil assembly 2 is fixed in the casing tube 3.

In the case of the conical honeycomb body 1 represented in FIG. 8, the fixing of the conical foil assembly 2 in the conical casing tube 3 takes place by the conical casing tube 3 having at a distance from the end openings 4, 5 an outer shoulder 12 corresponding to a width of the foil assembly 2. Once the introduction of the foil assembly 2 has been completed, it is fixed in the casing tube 3 by the outer shoulder 12.

Figure 9:
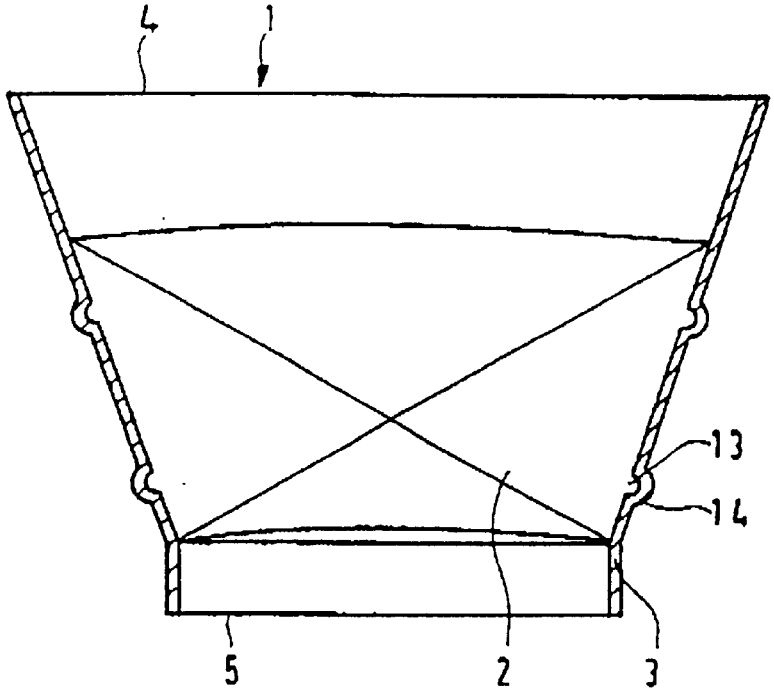
FIG. 9 is a sectional view of a seventh exemplary embodiment of the invention.
Figure 10:
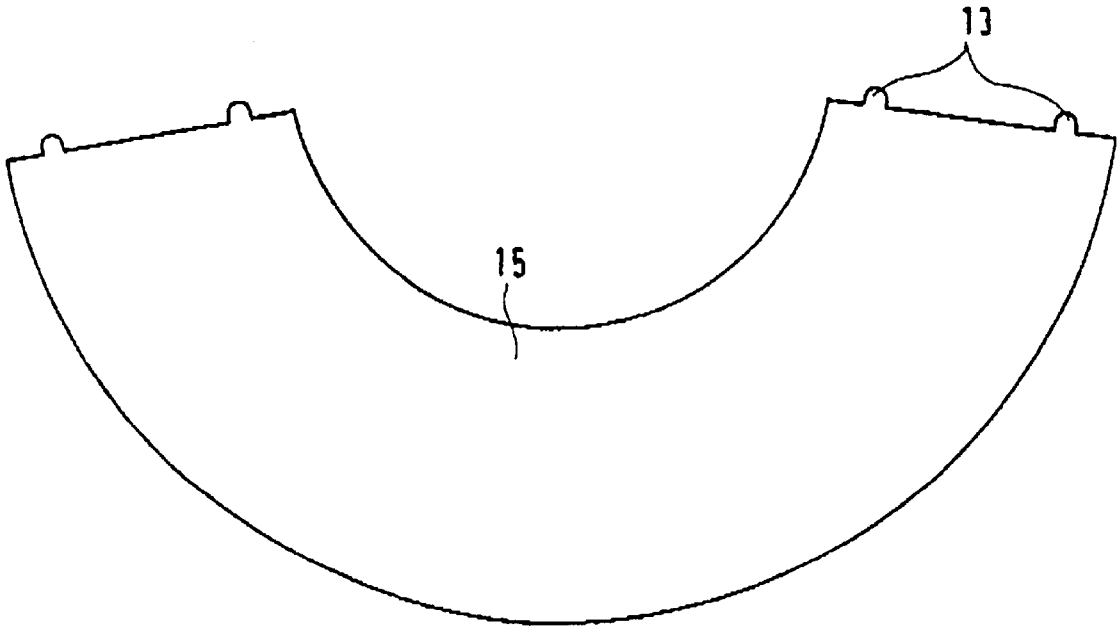
FIG. 10 is a plan view of an arcuate sheet-metal foil according to the invention.

FIG. 9 shows, as a further exemplary embodiment of the invention, fixing by a tongue-and-groove system 13, 14. For this purpose, the casing tube 3 has at least one outer bead 14 at a distance from the end openings 4, 5 in the region of the axial width of the foil assembly 2. The conical foil assembly 2 corresponding to this is produced from arcuate sheet-metal foils 15, at least some of which are structured, as represented in FIG. 10, in such a way that at least one detent 13 running at least around certain portions of the foil assembly 2 is formed laterally on the foil assembly 2. When the foil assembly 2 is introduced, the detents 13 slide into the outer bead 14, so that fixing takes place by the tongue-and-groove system 13, 14.

The solutions that are preferred according to the invention are advantageously distinguished by the fact that conical honeycomb bodies 1 with an increased mechanical stability can be produced at low cost. The variants also allow the function of the outer region of the conical honeycomb body 1 to be specifically influenced. In particular, beads 9, 11, constrictions 8, 12 and/or rings 7, 10 produce for example a screening effect, so that the passages through which a fluid can flow in the outer region of the casing tube 3 are not flowed through, or only to a slight extent. As a result, a type of air-gap insulation is produced, with the effect that the temperature of the casing tube 3 does not increase too much during operation under load in a motor vehicle.

We claim:

1. A method for producing a conical honeycomb body, which comprises the steps of forming a conical foil assembly having passages formed therein through which a fluid can flow, the conical foil assembly formed from arcuate sheet-metal foils being at least, one of stacked and wound to form the conical foil assembly, at least some of the arcuate sheet-metal foils being structured sheet-metal foils;

introducing the conical foil assembly into a conical casing tube having a first end opening formed therein and a second end opening formed therein, the first end opening having a given diameter being larger than a given diameter of the. second end opening;

fixing the conical foil assembly in the conical casing tube using a mechanical clamping aid, the mechanical clamping-aid extending annularly about an inner periphery of the conical casing tube at a distance from the first end opening and the second end opening; and subsequently connecting the arcuate sheet-metal foils at least partially to one another and to the conical casing tube by a joining technique.

2. The method for producing the conical honeycomb body according to claim 1, which comprises forming the mechanical clamping aid as a mechanically fixable ring disposed at a distance from the first end opening on an inner side of the conical casing tube.

3. The method for producing the conical honeycomb body according to claim 2, which comprises forming the mechanically fixable ring with mechanically fixable segments.

4. The method for producing the conical honeycomb body according to claim 1, which comprises forming the conical casing tube, at a distance from the first end opening, with a constriction being the mechanical clamping aid.

5. The method for producing the conical honeycomb body according to claim 1, which comprises forming the conical casing tube with an outer bead at a distance from the first end opening, and disposing the mechanical clamping aid, in a form of a prestressed ring, in the outer bead.

6. The method for producing the conical honeycomb body according to claim 5, which comprises disposing the prestressed ring in the outer bead in a reversibly mechanical manner.

7. The method for producing the conical honeycomb body according to claim 5, which comprises joining the prestressed ring to the outer bead by an irreversible joining technique.

8. The method for producing the conical honeycomb body according to claim 1, which comprises providing the conical casing tube with an inner bead at a distance from the first end opening, the inner bead functioning as the mechanical clamping aid.

9. The method for producing the conical honeycomb body according to claim 8, which comprises exerting an axial force on the conical casing tube after the conical foil assembly has been introduced into the casing tube, the inner bead being deformed such that the conical foil assembly is fixed in the conical casing tube.

10. The method for producing the conical honeycomb body according to claim 1, which comprises providing an outer shoulder in the conical casing tube at a distance from the first end opening and the second end opening, the outer shoulder having a width equal to an axial width of the conical foil assembly.

11. The method for producing the conical honeycomb body according to claim 1, which comprises forming the conical casing tube and the conical foil assembly with a tongue-and-groove system being the mechanical clamping aid.

12. The method for producing the conical honeycomb body according to claim 11, which comprises forming at least one outer bead on the conical casing tube at a distance from the first end opening and the second end opening, in a region of an axial width of the conical foil assembly.

13. The method for producing the conical honeycomb body according to claim 11, which comprises producing at least some of the structured arcuate sheet-metal foils with at least one detent running at least around certain portions of the conical foil assembly and the detent is formed laterally on the conical foil assembly.

14. The method for producing the conical honeycomb body according to claim 1, which comprises producing the conical honeycomb body as a catalyst support structure for a motor vehicle.

15. A conical honeycomb body, comprising:

a conical casing tube having a first end opening formed therein and a second end opening formed therein, said first end opening having a given diameter and said second end opening having a given diameter being smaller than said given diameter of said first end opening;

a conical foil assembly disposed in said conical casing tube and formed of arcuate sheet-metal foils being at least one of stacked and wound, at least some of said arcuate sheet-metal foils being structured sheet-metal foils and said arcuate sheet-metal foils being at least partially connected to each other and to said conical casing tube, said conical foil assembly further having passages formed therein through which a fluid can flow; and a mechanical clamping aid extending annularly about an inner periphery of said conical casing tube at a distance from said first end opening and said second end opening for fixing said conical foil assembly in said conical casing tube.

16. The conical honeycomb body according to claim 15, wherein:

said mechanically clamping aid is a mechanically fixed ring; and said conical casing tube has an inner side and at a distance from said first end opening on said inner side said mechanically fixable ring is fixed to said conical casing tube.

17. The conical honeycomb body according to claim 16, wherein said mechanically fixable ring has mechanically fixable segments connected to said conical casing tube.

18. The conical honeycomb body according to claim 15, wherein said mechanical clamping aid is a constriction formed in said casing tube at a distance from said first end opening.

19. The conical honeycomb body according to claim 15, wherein said conical casing tube has at a distance from said first end opening an outer bead, and said mechanical clamping aid is a prestressed ring disposed in said outer bead.

20. The conical honeycomb body according to claim 19, wherein said prestressed ring is disposed in said outer bead in a reversible mechanical manner.

21. The conical honeycomb body according to claim 19, wherein said prestressed ring is fixed to said outer bead in an irreversible joining manner.

22. The conical honeycomb body according to claim 15, wherein said mechanical clamping aid is an inner beading formed in said conical casing tube at a distance from said first end opening.

23. The conical honeycomb body according to claim 15, wherein said mechanical clamping aid is an outer shoulder formed in said conical casing tube at a distance from said first end opening and said second end opening for retaining said conical foil assembly, said outer shoulder having a given width equal to a given width of said conical foil assembly.

24. The conical honeycomb body according to claim 15, wherein said mechanical clamping aid is a tongue-and-groove system formed in said conical casing tube and said conical foil assembly.

25. The conical honeycomb body according to claim 24, wherein said conical casing tube has at a distance from said first end opening and said second opening, in a region of an axial width of said conical foil assembly, at least one outer bead.

26. The conical honeycomb body according to claim 24, wherein at least some of said structured arcuate sheet-metal foils are formed such that at least one detent, running at least around certain portions of said conical foil assembly, is formed laterally on said conical foil assembly.

27. The conical honeycomb body according to claim 15, wherein the conical honeycomb body is a catalyst support structure for a motor vehicle.

* * * * *